United States Patent [19]

Hanson et al.

[11] Patent Number: 5,024,035

[45] Date of Patent: Jun. 18, 1991

[54] BUILDING BLOCK AND STRUCTURES FORMED THEREFROM

[75] Inventors: Gary N. Hanson; Keith W. Inness, both of Seattle, Wash.

[73] Assignee: Insulock Corporation, Seattle, Wash.

[21] Appl. No.: 258,052

[22] Filed: Apr. 28, 1981

Related U.S. Application Data

[63] Continuation of Ser. No. 85,871, Oct. 18, 1979, abandoned, which is a continuation of Ser. No. 966,082, Dec. 4, 1978, abandoned.

[51] Int. Cl.[5] ..... E04C 1/10

[52] U.S. Cl. ..... 52/591; 52/594; 52/309.12

[58] Field of Search ..... 52/589, 591, 594, 309.12

[56] References Cited

U.S. PATENT DOCUMENTS

| | | | |
|---|---|---|---|
| 752,694 | 2/1904 | Lund | 52/595 |
| 786,884 | 4/1905 | Faulkner | 52/591 |
| 1,365,162 | 1/1921 | Ferguson | 52/591 |
| 1,418,168 | 5/1922 | Preston | 52/591 |
| 1,567,085 | 12/1925 | Rowland | 52/586 |
| 2,176,986 | 10/1939 | Briscoe | 52/565 |
| 3,552,076 | 1/1971 | Gregori | 52/309.12 |
| 3,788,020 | 1/1974 | Gregori | 52/426 |
| 4,041,670 | 8/1977 | Kaplan | 52/594 |

FOREIGN PATENT DOCUMENTS

| | | | |
|---|---|---|---|
| 256279 | 5/1963 | Australia | 52/591 |
| 93507 | 7/1922 | Austria | 52/503 |
| 826584 | 11/1969 | Canada | 52/309.1 |
| 29838 | 7/1922 | Denmark | 52/505 |
| 0001360 | 4/1979 | European Pat. Off. | 52/591 |
| 915121 | 7/1946 | France | 52/591 |
| 2074669 | 8/1971 | France . | |

*Primary Examiner*—James L. Ridgill, Jr.
*Attorney, Agent, or Firm*—George M. Cole

[57] ABSTRACT

A mortarless, lightweight building block and walls formed therefrom. The block is generally rectangular and comprises side walls, end walls, and an interior wall which divides the interior of the block into two vertical passages through the block. In certain blocks, parts of the end and interior walls are removed to form horizontal channels through the blocks. The blocks are provided with projections and recesses having rectangular cross sections by which means they may be interlocked together to form walls. In such a wall, the vertical passages and horizontal channels may receive reinforcing structures to impart added strength and load bearing properties to the wall.

3 Claims, 4 Drawing Sheets

20
18a
18b
20
18c
12
18d
18e
20
18f
90
90
90
20
20
20

BUILDING BLOCK AND STRUCTURES FORMED THEREFROM

This application is a continuation of application Ser. No. 085,871 filed Oct. 18, 1979, which is a continuation of Ser. No. 966,082, filed Dec. 4, 1978, now both abandoned.

FIELD OF THE INVENTION

This invention relates to interlocking building blocks and walls formed therefrom.

DESCRIPTION OF THE PRIOR ART

A number attempts have been made to provide building blocks capable of being joined together without the use of mortar into walls or other loading structures. Ideally, such mortarless building blocks should be lightweight so that they are easy to handle and transport, easy to use so that the walls can be quickly constructed by unskilled workmen, and adapted to accept varying degrees of reinforcement so that the walls may readily be constructed to meet any degree of load bearing requirements.

Prior mortarless building blocks have fallen considerably short of these ideals. No prior blocks have provided practical, mortarless building elements which are adapted, when assembled into a wall, of receiving a variable amount of reinforcement to provide different degrees of strength and stability. A number of prior blocks are designed to be filled with cement or other heavy material at the time they are assembled or constructed. Although such blocks are comparatively massive and thereby impart some stability to the finished wall, they provide no advantage whatsoever in terms of ease of handling or transportation over conventional cinder blocks. Other prior blocks have sought to achieve stability by providing flared interlocking structures between adjacent blocks. In addition to increasing the complexity of the blocks' designs, such flared structures also add considerably to the difficulty of assembling the blocks into walls, slice such blocks may only be brought together from certain directions or angles.

SUMMARY OF THE INVENTION

This invention provides novel, lightweight, highly insulating building blocks in a number of embodiments, which blocks are capable of being joined together without mortar to form a wall or other load bearing structure. The blocks are extremely lightweight and easily used by unskilled laborers. The blocks are designed such that when joined together into a wall, the interior of the wall contains forms for a variable number of reinforcing structures. Such structures may be provided to yield walls of differing strengths and load bearing abilities.

The building blocks of the present invention have a generally rectangular exterior configuration, and are composed of urethane foam or other lightweight, highly insulating non-cementitious material. In one embodiment, the block comprises a pair of opposed side walls; a pair of opposed end walls having heights equal to that of the side walls; an interior wall having a height equal to that of the side walls and extending between the side walls approximately parallel to the end walls, the interior wall forming two vertical passages through the blocks of approximately equal, rectangular cross sections; projections on the upper surfaces of the end, side and interior walls the projections being formed into two identical patterns respectively associated with said two passages; and the lower surfaces of the side, end and interior walls being shaped so as to form recesses identical to the projections in size and shape, and directly below the projections in position. In a second embodiment, referred to as a horizontal support block, the upper portions of the end and interior walls are removed to form a horizontal channel extending through the block. Blocks according to the present invention may be used to construct walls comprising a series to horizontal rows, with adjacent rows offset horizontally by half tho length of a block, and with projections of the blocks in each row being received within the recesses of the blocks of the row above. Certain rows may consist entirely of horizontal support blocks, and horizontal reinforcing structures may be placed through the channels of the blocks in such rows. Vertical reinforcing structures may be placed through the vertical openings formed by the passages of several blocks. By such means, a wall or other structure having almost any desired amount of reinforcing may be constructed.

These and other features and advantages of the invention will be apparent from the detailed description and claims to follow taken in conjunction with the accompanying drawings.

DETAILED DESCRIPTION OF THE DRAWINGS

Figure 1:
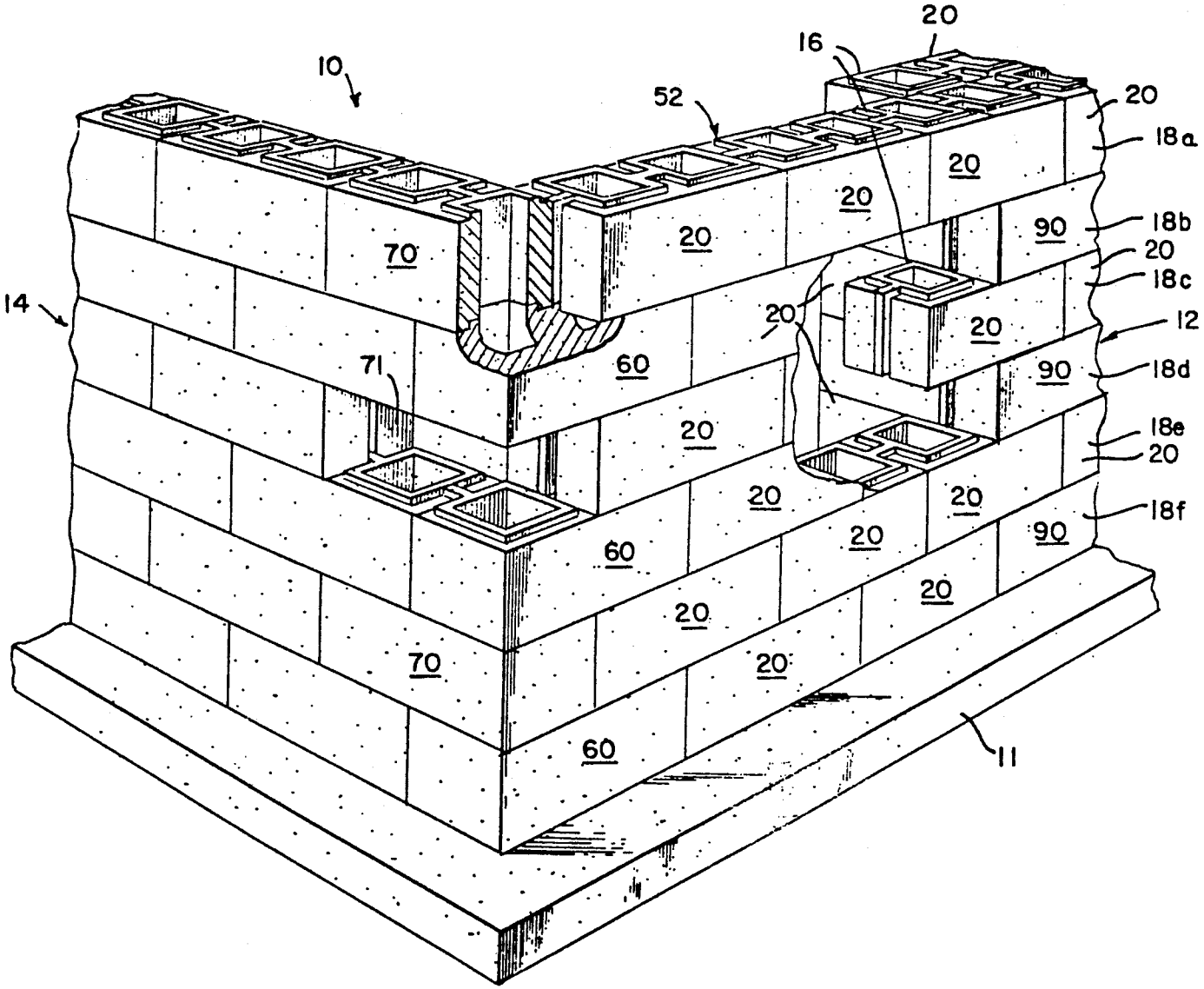
FIG. 1 presents a partly broken away perspective view of a part of a building structure assembled from building blocks according the present invention.

FIG. 1 depicts a structure 10 comprised of mortarless building blocks according to the present invention. Structure 10, is shown, consists of foundation 11, walls 12, 14 and support structure 16 extending inwardly from wall 12. Each wall consists of a series of horizontal rows, such as rows 18*a–f* comprising wall 12, positioned one on top of another. Each such row is composed principally of rectangular blocks 20 placed end to end. With two exceptions to be described below, all the blocks of the present invention preferably have identical outer dimensions, which dimensions may be the same as that of a standard 8"×8"×16" cinder block.

Each row 18*e–f* is horizontally offset from the rows above and beneath it by one half of the length of blocks 20.

Figure 2:
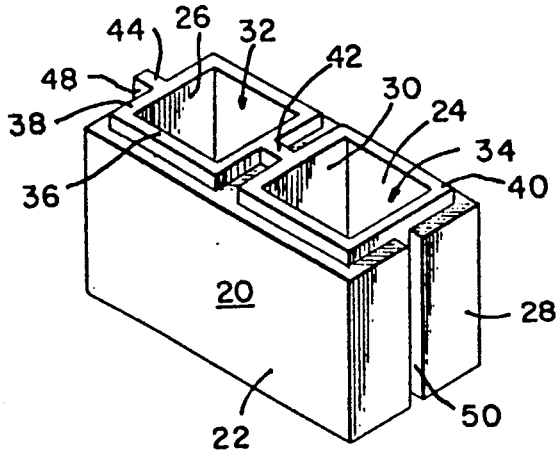
FIG. 2 presents a perspective view of a building block according to the present invention.
Figure 3:
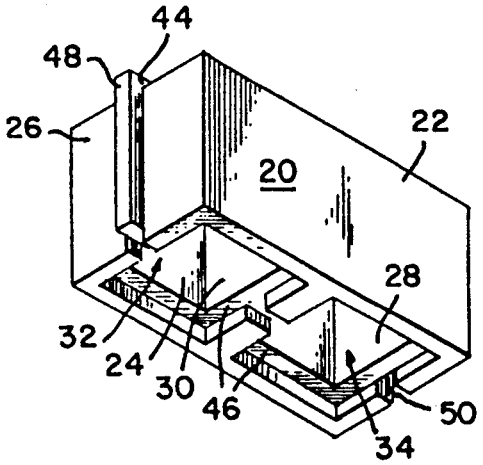
FIG. 3 presents a perspective view of the block of FIG. 2 as seen from below.

FIGS. 2 and 3 depict, from above and below respectively, one of the blocks 20 of FIG. 1. Block 20, as well as the other building blocks described herein, are made from urethane foam, compressed resin reinforced sawdust, or other lightweight, non-cementitious material. The use of such material results in a block which has excellent insulating properties, and which is extremely lightweight for easy transportation and handling. Block 20 comprises side walls 22, 24, end walls 26, 28 and interior wall 30. All walls are of equal height end extend from the top to the bottom of block 20. Interior wall 30 extends between side walls 22, 24 from points intermediate their ends so as to form rectangular passages 32, 34 of identical size. Passages 32, 34 extend entirely through block 20 in a vertical direction and are of uniform cross section throughout.

The upper surfaces of side walls 22, 24, end walls 26, 28 end interior wall 30 carry a set of continuous projections 36. The projections are of constant, rectangular cross section and have a width less than the widths of the narrowest walls on which they are mounted. Projections 36 are formed in two identical rectangular portions 38, 40, and two short linear portions 42, 44 positioned midway between and parallel to side walls 22, 24. Linear portion 42 extends between rectangular portions 38 and 40, and linear portion 44 extends outwards from rectangular portion 38. As used here in, linear portion 44 refers to that structure overlying end wall 26, and not to that structure, described below, extending outwardly from such end wall. The rectangular portions 38, 40 completely surround the upper edges of passages 32, 34 respectively, and the inwardly facing sides of such rectangular portions are coplanar with the inner surfaces of the walls forming passages 32, 34.

The lower surfaces of side walls 22, 23, end walls 26, 28 and interior wall 30 carry a set of continuous recesses 46 having sizes and shapes identical to projections 36 and positioned directly below and corresponding to such projections. When two blocks 20 are positioned one on top of another, the projections of the lower block frictionally fit within the recesses of the upper block, by which means the blocks are aligned and secured together.

Block 20 additionally comprises the lateral projection 48 outstanding from end wall 26 and the lateral recess 50 formed on end wall 28. Lateral projection 48 and lateral recess 50 each has a rectangular cross section of dimensions equal to those of projections 36 end recesses 46. Lateral recess 50 extends vertically the full height of end wall 28 intermediate its sides. Lateral projection 48 has a total height equal to that of end wall 26, but is offset upwardly a distance equal to the height of projection 36, and therefore to the depth of recesses 46. Thus the upper portion of lateral projection 48 forms a uniform continuous structure with linear portion 44 of projection 36, and the length of such continuous structure is identical to the length of linear portion 42.

A series of blocks 29 may be positioned end to end to form horizontal rows 18*a–f* (FIG. 1) with lateral projections frictionally fitted into lateral recesses of adjacent blocks. When such a tow is constructed, the projections 36 of the several blocks, together with the upper portions of lateral projections 48, form a pattern of connected rectangles on the upper surfaces of blocks 20, which pattern repeats itself twice per block, as indicated at 52 in FIG. 1. Similarly, recesses 46 together with the lower ends of lateral recesses 50, form an identical repeating pattern of recesses on the lower surface s of such blocks. Thus, when horizontal rows of blocks 20 are positioned one above another with projections 36 and recesses 46 frictionally fitted together to form walls, blocks in adjacent rows may be aligned either directly above or below one another or, preferably, offset horizontally by half the length of one block, as indicated in FIG. 1.

Figure 4:
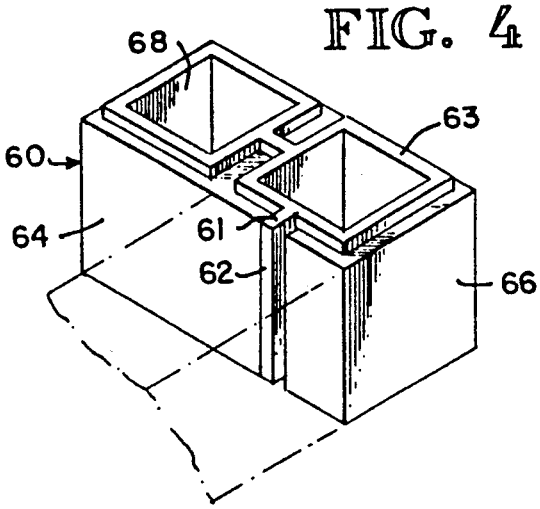
FIG. 4 presents a perspective view of a left hand corner block according to the present invention.

FIG. 4 depicts a lefthand corner block 60. Block 60 is identical to block 20 except that lateral projection 62 has been positioned on side wall 64 rather than on end wall 66, and linear projection 61 has been relocated such that it connects lateral projection 62 and rectangular projection 63. The distance between lateral projection 62 and end wall 66 is identical to the distance between lateral projection 48 and side wall 22 (FIG. 3). End wall 68 carries a lateral recess (not shown identical to lateral recess 50 of FIG. 2. FIG. 1 depicts the incorporation of several lefthand corner blocks 60 into an assembled structure.

Figure 5:
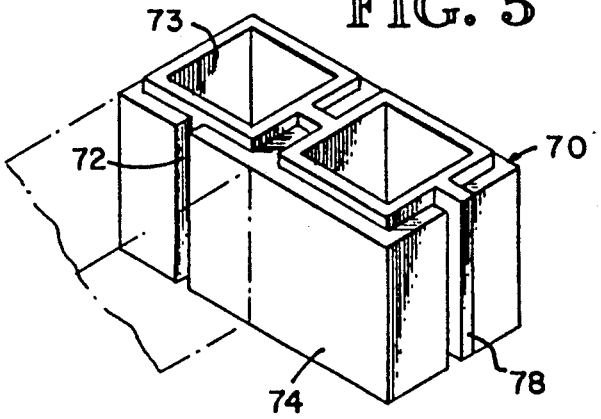
FIG. 5 presents a perspective view of a right hand corner block according to the present invention.

FIG. 5 depicts a righthand corner block 70. Block 70 is identical to block 20 except that lateral recess 72 has been positioned on side wall 74. The distance between lateral recess 72 and end wall 73 is equal to the distance between lateral recess 50 and side wall 22 (FIG. 2). FIG. 1 illustrates the incorporation of several righthand corner blocks 70 into an assembled structure, as well as a broken-away area 71 where such a block 70 would be placed.

Figure 6:
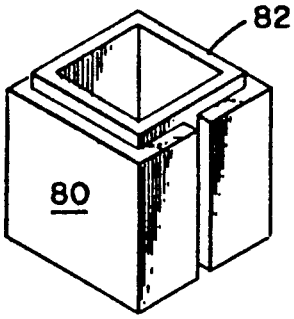
FIG. 6 presents a perspective view of a half unit block according to the present invention.

FIG. 6 shows a half-section block 80. Block 80 is identical to the righthand half of block 20 (FIG. 2), except that projection 82 does not include a linear portion such as 42 in FIG. 2. Half-section blocks 80 permit the construction of windows or doorways in walls in which adjacent rows are offset, as in FIG. 1.

Figure 7:
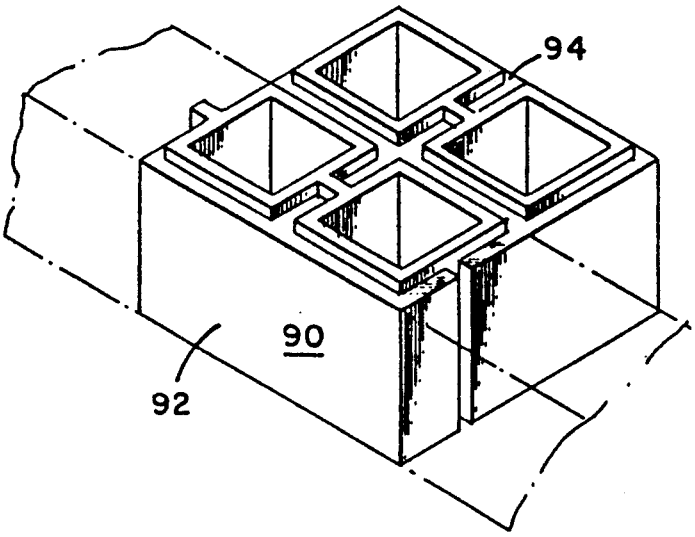
FIG. 7 presents a perspective view of a double unit reinforcing block according to the present invention.

FIG. 7 depicts a pylon block 90, which block is similar to two blocks 20 joined side to side. In particular, one-half 92 of block 90 is identical to block 20, whereas the other half 94 is similar to block 20 except that it has neither a lateral projection nor a lateral recess. Pylon blocks 90 are used to form a double thickness section of a wall or other structure to increase the strength and stability of the wall at such section. FIG. 1 shows three pylon blocks 90 positioned one above another in rows 18*b*, 18*d* and 18*f*. Blocks 20 are positioned between the rear halves 94 of the pylon blocks 90 to form a double thickness support structure 16 in wall 12. Such a support structure increases the strength of the wall 12 in and of itself, and it is further capable of receiving a supplemental reinforcing structure as described below.

Figure 8:
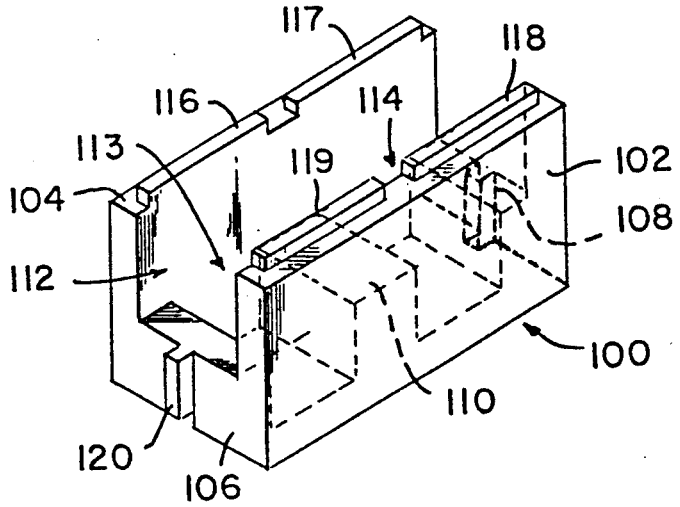
FIG. 8 presents a perspective view of a building block according to the present invention adapted to receive a horizontal reinforcing structure.

FIG. 8 illustrates a horizontal support block 100. Support block 100 is identical to block 20, except that the entire upper portions of the end and interior walls, as well as the projections and recesses carried thereon, have been removed. Thus, block 100 comprises side walls 102, 104, end walls 106, 108 and interior wall 110. End walls 106, 108 and interior wall 110 are all of a height considerably less than the height of side walls 102, 104, such that a longitudinal, horizontal U-shaped channel 112 is formed in the upper interior portion of block 100. Interior wall 110 extends between side walls 102, 104 from points intermediate their ends so as to form equal size rectangular passages 113, 114 extending through block 100 in a vertical direction. Passages 113, 114 correspond to passages 32, 34 of block 20.

The lower surfaces of side walls 102, 104, end walls 106, 108 and interior wall 110 are formed so as to form recesses (not shown) in the lower surfaces thereof which are identical to recesses 46 on the lower surfaces of block 20. Side walls 102, 104 carry projections 116–119 on the upper surfaces thereof, such projections being identical to the side wall sections of rectangular projections 28, 40 of block 20. End walls 106, 108 respectively carry lateral projection 120 and a lateral recess (not shown), such lateral recess and projection being identical to lateral projection 48 and lateral recess 50 of block 20, except that their upper sections have been removed along with the upper sections of end walls 106, 108.

Figure 9:
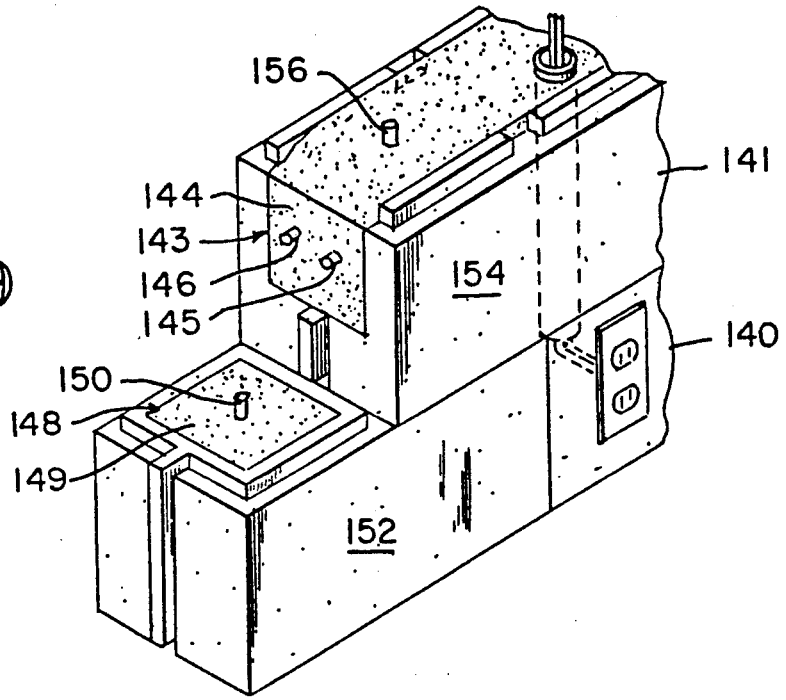
FIG. 9 presents a perspective view of a reinforced section of a wall comprising the blocks of FIGS. 2 and 8.
Figure 10:
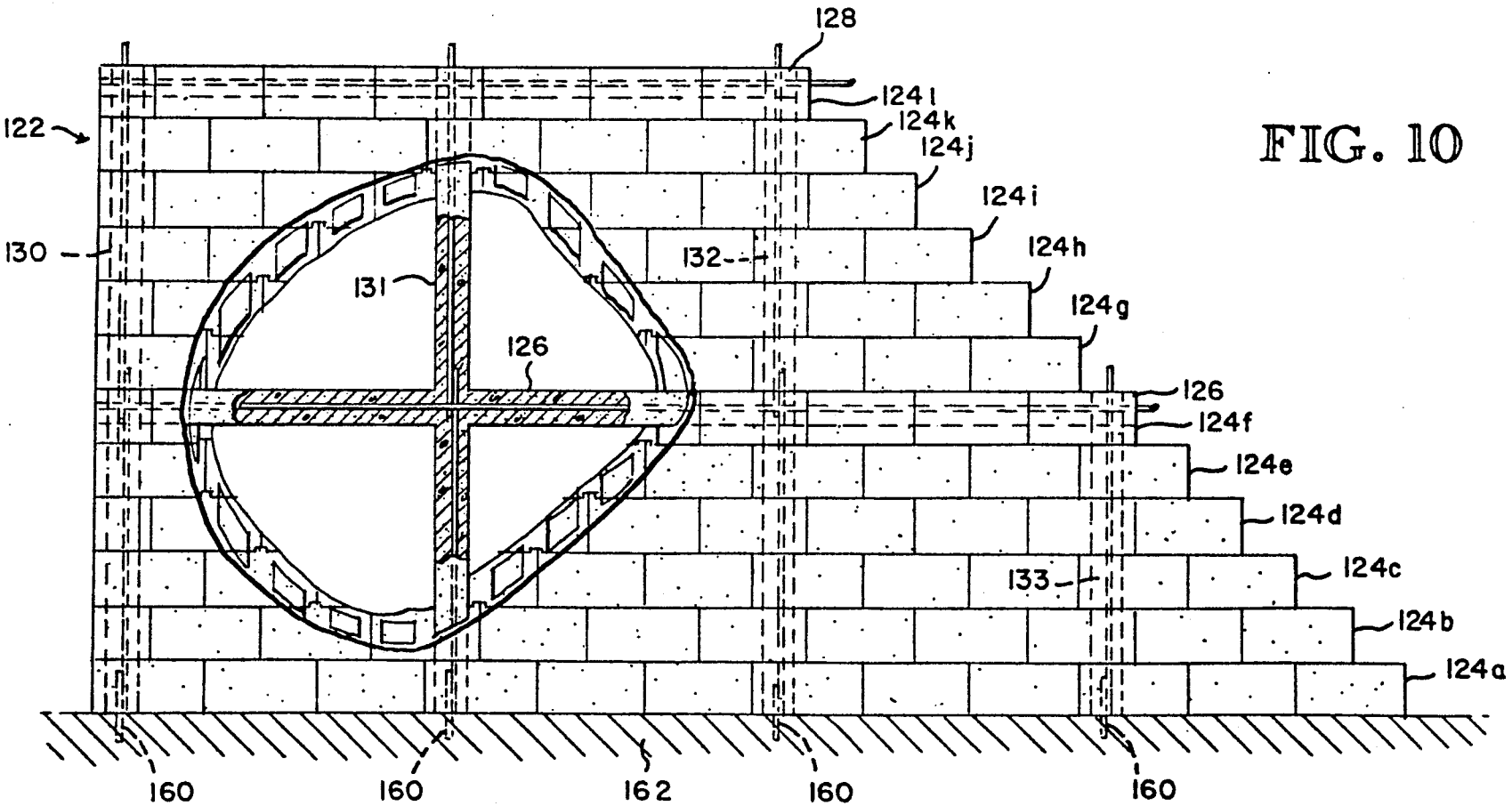
FIG. 10 presents a side elevational view, partly broken away, of a reinforced wall according to the present invention

FIGS. 9 and 10 illustrate the way in which walls or other structure constructed of blocks according to the present invention may be reinforced to provide almost any desired amount of strength or stability. Referring initially to FIG. 10, there is shown a wall 122 comprising horizontal rows 124*a–l* stacked one on top of another as already described. Each row is offset from adjacent rows by one-half the length of an individual block. Rows 124*a–e* and *g–k* are made up entirely of blocks 20, whereas rows 124*f* and 124*l* are composed entirely of horizontal support blocks 100. In each row, adjacent blocks are joined together via their lateral projections and recesses. Adjacent rows are joined via the projections and recesses on the upper and lower surfaces thereof.

Each row of horizontal support blocks 124*f*, 124*l* carries a horizontal reinforcing structure 126, 128 respectively, such reinforcing structures extending through the longitudinal channels 112 of blocks 100. The frequency with which rows of horizontal support blocks appear may be varied as desired.

Further, periodically throughout wall 122, vertical support structures 130–133 extend through aligned passages 32, 34 or 113, 114 in blocks 20 or 100 respectively. In wall 122, as shown, such vertical reinforcing structures 130–133 extend through one of the passages of every fourth block in each row, although here again any other repeat frequency could be used as desired. Thus the number of vertical and horizontal reinforcing structure incorporated into a wall may be adjusted based on the load bearing requirements of the wall end related factors. In a well intended to carry any substantial load, essentially all of such load may be borne by the reinforcing structures, a feature which permits the use of extremely lightweight and highly insulating material for the blocks. Where the reinforcing structures comprise concrete, the blocks of the present invention may be viewed as forms as well as structural elements.

FIG. 9 illustrates details of one type of reinforcing structure. In FIG. 9, the lower row 140 is composed of blocks 20, whereas the upper row 141 is composed of horizontal support blocks 100. The horizontal reinforcing structure 143 is shown consisting of concrete 144 reinforced by rebar 145, 146, while the vertical reinforcing structure 148 consists of concrete 149 reinforced by rebar 150. Primarily for purposes of illustration, a second vertical reinforcing structure is shown extending through blocks 152, 154, and this reinforcing structure is reinforced by rebar 156. Other material, such as logs or steel sleeving, may be used as well as reinforced concrete for the reinforcing structures. FIG. 9 also illustrates the way in which the spaces within the walls provided for therein forcing structures can also be used as conduits for electrical cablIng and the like.

As stated above, a number of pylon blocks 90 can be used to construct a support structure 16 (FIG. 1) at those sections of a wall where additional strength is required. The back half 94 of such a support structure may receive vertical reinforcing structures such as those already described to provide an even greater measure of strength and stability.

Referring again to FIG. 10, wall 122 as shown therein is constructed by first providing posts 160 extending from foundation or footings 162. Rebar for the lower portions of vertical reinforcing structures 130–133 is then attached to such posts, and blocks are then stacked to form rows 124*a–f*. Since such blocks are extremely light-weight and easily fitted together, the construction of such rows is a rapid process, even for unskilled labor. Rebar for horizontal reinforcing structure 126 and for the next higher portion of vertical reinforcing structures 130–133 is then fixed in position, after which concrete is poured to form horizontal reinforcing structure 126 and the lower sections of vertical reinforcing structures 133–133. Prior to pouring, squares of cardboard or any other convenient material are placed over those passages of the row 124*f* blocks where vertical reinforcement is not wanted. This construction process may be repeated indefinitely to form walls of any height. The finished wall contains a reinforced concrete grid which tightly locks the blocks together into a strong and durable wall.

While the preferred embodiment of this invention has been illustrated and described herein, it should be understood that variations will be come apparent to one skilled in the art. Accordingly, the invention is not to be limited to the specific embodiment illustrated and described herein and the true scope and spirit of the invention are to be determine by reference to the appended claims.

What is claimed is:

1. A wall structure, comprising:

a) a plurality of lightweight, non-cementitious, resilient, plastic foam material, first blocks, each first block having a generally rectangular exterior configuration and comprising a pair of opposed first side walls; a pair of opposed first end walls having heights equal to that of the first side walls; a first interior wall having a height equal to that of the first side walls and extending between the first side walls approximately parallel to the first end walls, the first interior wall forming two first vertical passages through the first blocks of approximately equal, rectangular cross-sections; first projections on the upper surfaces of the first end, side and interior walls, the firt projections being formed into two identical first patterns respectively associated with said two first passages; and the lower surfaces of the first side, end and interior walls being shaped so as to form first recesses identical to the first projections in size and shape, and directly below the first projections in position, the first blocks being positioned side by side to form first horizontal rows;

b) a plurality of lightweight, non-cementitious, resilient, plastic foam material second blocks, each second block having an exterior size and configuration similar to the first blocks and comprising a pair of opposed second side walls; a pair of opposed second end walls having heights appreciably less than that of the second side walls; a second interior wall having a height equal to that of the second end walls and extending between the second side walls approximately parallel to the second end walls; the second interior wall forming two second vertical passages through the second forms of approximately equal, rectangular cross-sections; second projections on the upper surface of each second side wall, the second projections being formed into two identical second patterns respectively associated with the two second passages; and the lower surfaces of the second side, end and interior walls being shaped so as to form second recesses, a portion of such second recesses being identical to the second projections in size and shape and directly below the second projections in position, the second blocks being positioned side by side to form second horizontal rows and horizontal passages through said horizontal row of second blocks, said first and second rows being positioned one on top of another such that the projections of the forms in each row are received within the recesses of the forms in the row above and the passages in successive rows are aligned to form vertical openings extending through more than one row; and c) load bearing structures extending at least through one of said vertical openings.

2. The wall structure of claim 1 and wherein load bearing means extend through said horizontal passages.

3. The wall of claim 2, wherein the horizontal and vertical load bearing structures comprise metal reinforced concrete.

* * * * *